United States Patent [19]

Radzik

[11] 4,317,476

[45] Mar. 2, 1982

[54] WOOD SPLITTING DEVICE

[76] Inventor: Edward S. Radzik, 1811 11th La., Friendship, Wis. 53934

[21] Appl. No.: 97,653

[22] Filed: Nov. 27, 1979

[51] Int. Cl.[3] ..... B27L 7/00

[52] U.S. Cl. ..... 144/194; 74/14; 180/53 WA

[58] Field of Search ..... 144/193 R, 194, 193 D; 180/53 WA, 53 FE, 53 R; 74/14

[56] References Cited

U.S. PATENT DOCUMENTS

| | | | |
|---|---|---|---|
| 3,670,789 | 6/1972 | Long | 144/193 D |
| 4,027,709 | 6/1977 | Thackery | 144/193 R |
| 4,141,395 | 2/1979 | Arzt | 144/193 R |

FOREIGN PATENT DOCUMENTS

| | | | |
|---|---|---|---|
| 186391 | 8/1956 | Austria | 144/194 |
| 2814249 | 7/1979 | Fed. Rep. of Germany | 144/194 |

*Primary Examiner*—W. D. Bray

*Attorney, Agent, or Firm*—Hill, Van Santen, Steadman, Chiara & Simpson

[57] ABSTRACT

A highly portable wood splitting device adapted to be powered by a self-propelled motor vehicle having driven wheels interconnected by a set of differential gears includes a pair of drive rollers driven by one of the vehicle wheels, at least one ramp to enable the vehicle to drive onto the device, a set of gears and chains that enables at least one roller to drive a horizontal shaft carrying a threaded conical wedge, there preferably being two such arrangements driven by the set of rollers, along with removable stops for preventing log rotation and an electrical switch for disabling the vehicle engine.

4 Claims, 1 Drawing Figure

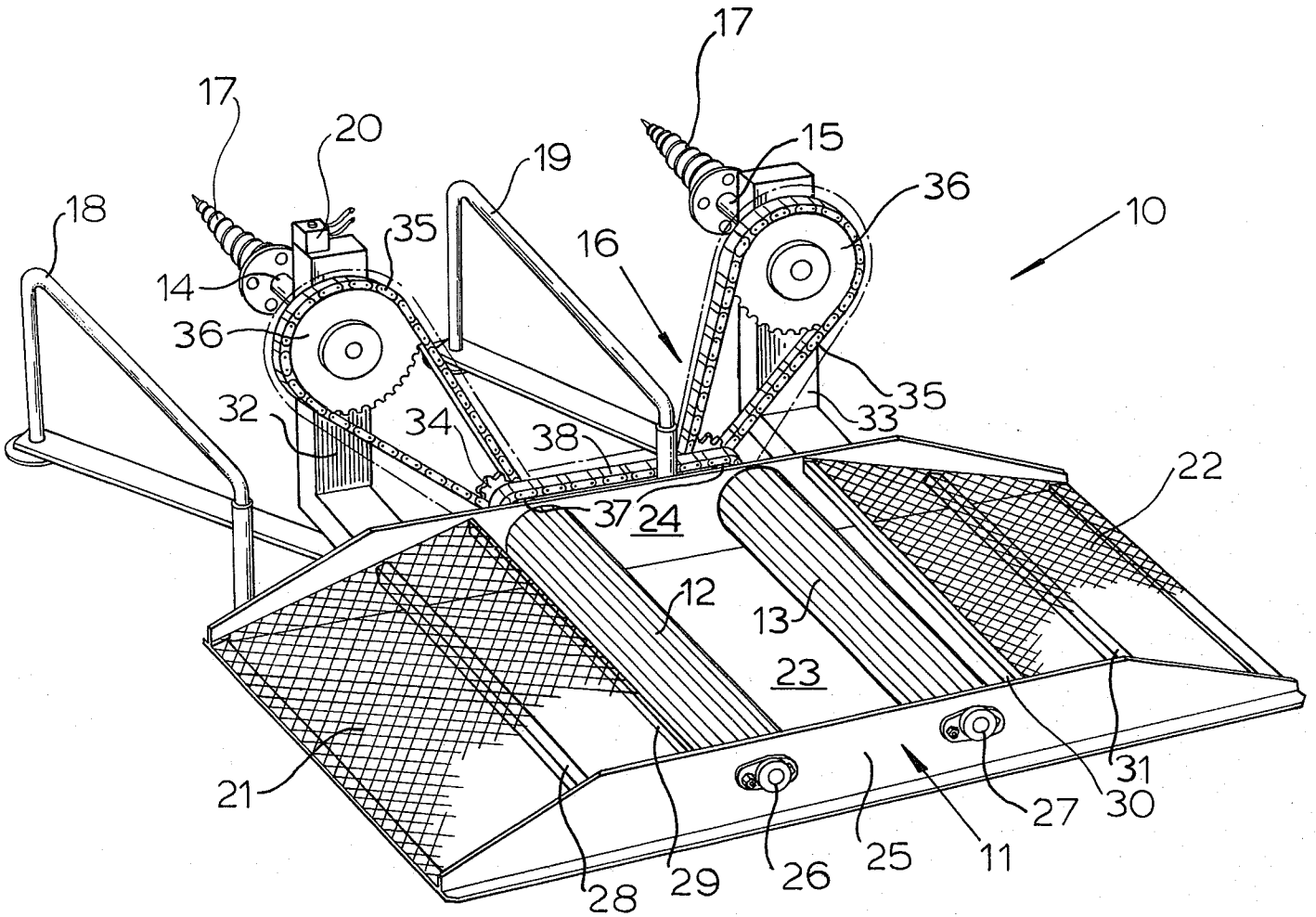
10
11
12
13
14
15
16
17
17
18
19
20
21
22
23
24
25
26
27
28
29
30
31
32
33
34
35
35
36
36
37
38

WOOD SPLITTING DEVICE

BACKGROUND OF THE INVENTION

1. Field of the Invention

This invention pertains to a structure by which logs or chunks of wood are split.

2. Prior Art

A number of different types of log splitting devices have been proposed, and the two of them that appear to be the most pertinent, known to me, are those shown in U.S. Pat. Nos. 3,670,789 and 4,141,395.

The wood splitting apparatus of U.S. Pat. No. 3,670,789 involves a relatively rigid frame that supports a gasoline engine, which through a gear box, drives a threaded conical wedge for entering portions of logs that are of suitable lengths for combustion. During splitting, the chunk of wood is supported on the frame which arrangement prevents rotation of the log. The axis of the conical wedge best needs to be transverse to the axis of the log. The massive frame and the weight of the engine renders this device a bit massive, thus detracting from its portability. The gear box appears to provide an offset from the output shaft of the engine, but does not appear to alter the effective speed.

U.S. Pat. No. 4,141,395 is also a bit massive in that employs two elongated screws for shifting a pusher there along, along with structure at the opposite ends of the screws to permit over-running by decoupling the nuts that engage the screws. This device has a substantial disadvantage in that once one log has been split, it becomes necessary for the operator to return to the cab of the vehicle and to shift the transmission of the vehicle into reverse to restore the pusher to the starting position. Then the log is loaded, and once more the operator must return to the cab to shift the transmission of the vehicle into a forward drive. Thus for each log or piece of wood split, one cycle of operation requires that the operator make two trips to the cab of the vehicle.

SUMMARY OF THE INVENTION

The present invention is directed to a combination of features some of which are broadly shown in both of these references, but uniquely combined to reduce mass and hence to increase portability, to have potentially twice as much splitting ability, and to eliminate the trips back and forth between the splitter and the vehicle cab. This result has been achieved without adoption of other disadvantages contained in other less pertinent patents, namely that just like the two relevent patents mentioned above, there is no jacking of the vehicle needed, there is no mechanical assembly to a driven vehicle wheel and disassembly therefrom, and there is no direct connection to any power takeoff that a tractor vehicle may have. To that end the wood splitting device of the invention is highly portable and energy efficient and includes a pair of horizontal drive rollers adapted to be driven by a driven wheel of the vehicle, a horizontal shaft supporting a threaded conical wedge, and interconnecting means drivably connecting at least one of the rollers with such horizontal shaft. A speed reduction is disclosed as part of the interconnecting means, enabling the engine of the vehicle to be operated at idling speed. A simple stop precludes rotation of the log, and a disabling switch is disposed on the assembly to enable stopping the vehicle engine without leaving the wood splitting device. Preferably, there are two such shafts simultaneously driving two such fitted conical wedges.

Accordingly, it is an object of the present invention to provide a powerful wood splitting device which uses a minimum of material to render it highly portable, thereby minimizing manufacturing cost, sale price, energy used in manufacturing the device, and energy used in operating the device.

Another object of the invention is to enable the splitting of longer logs, doing so more efficiently.

Many other advantages, features and additional objects of the present invention will become manifest to those versed in the art upon making reference to the detailed description and the accompanying drawing in which a preferred structural embodiment incorporating the principles of the present invention is shown by way of illustrative example.

ON THE DRAWING

The single FIGURE is a perspective view of a portable wood splitting device provided in accordance with the present invention.

AS SHOWN ON THE DRAWINGS

This invention is provided to encourage the use of alternate energy sources such as renewable wood, by making it easier to split wood to the size desired or needed for a stove, heater or fireplace, thereby to encourage more use of wood for energy where wood is plentiful. To that end, the principles of the present invention are particularly useful when embodied in a portable wood splitting device such as shown on the drawing, generally indicated by the numeral 10. The device 10 includes a frame 11, a pair of drive rollers 12,13, a pair of horizontal shafts 14,15, interconnecting means generally indicated by the reference numeral 16, each shaft 14,15 having a threaded conical wedge 17,17 respectively. A pair of removable stops 18,19 are secured to the frame 11 for being engaged by a log to prevent rotation thereof during splitting. An electric switch 20 is disposed on the frame 11 for connection into a circuit of a motor vehicle to stop its operation. To make the device easier to use, there is provided a pair of ramps 21,22 which extend from the bottom of the frame up to the rollers 12,13.

The frame 11 has a base portion 23 which is somewhat wider than a typical vehicle wheel, and from the longitudinal edges thereof, there extend upwardly a pair of vertical flanges 24,25 that provide rotatable support for the spaced rollers 12,13 through appropriate bearings 26,27 disposed at each end. The frame 11 also includes appropriate cross braces 28–31 for supporting the ramps 21,22. The frame 11 further has a pair of L-shaped brackets 32,33 which extend outwardly away from the rollers and thence upwardly to a higher level than the rollers at which level the horizontal shafts 14,15 are rotatably supported by suitable bearings.

The drive rollers 12,13 are suitably fluted or otherwise provided with an appropriate surface to minimize slippage between each roller and the tire of the driven wheel.

The interconnecting means 16 includes a sprocket 34, which is corotatable with one of the rollers 12,13, connected by a suitable chain 35 to a second somewhat larger sprocket 36, which is corotatably secured to one of the shafts 14,15. It is also preferable to provide a further sprocket 37 respectively in association with each of the rollers 12,13, the sprockets 37 being of the same size and being interconnected by a further chain 38. The chain 38 serves both as a timing chain so that the two threaded conical wedges will rotate at the same rate, and also as an energy transfer chain so that if there should be slippage at one of the rollers 12,13 between it and the vehicle wheel, the other roller can transfer driving power to both of the threaded conical wedges 17. The interconnecting means 16 is enclosed in a housing, not shown, which has been omitted to facilitate illustration of the operative components. In a preferred embodiment, the step-down created by the differences in sizes of the sprockets 34,36 produces a speed reduction having a ratio of 16 to 1.

Preferably, the corotatability present between each of the sprockets 36 and the respective horizontal shafts 14,15 is provided by a shear pin, sized to enable the transmittal of a torque no greater than about 1500 lb-ft.

The electrical disabling switch 20 preferably has one lead that is connected to the electrical ground of the engine of the motor vehicle while the other lead is clipped onto the ignition coil so that depression or operation of the switch 20 will instantly shut off the engine if some emergency or special condition warrants doing so, without any need for the operator to leave the splitting device 10 to go to the cab of the motor vehicle to shut off the engine.

The stops 18,19 are secured to the frame 11, extend generally in parallel to each other, and are offset from and lie in planes extending generally in parallel to the rotational axes of the threaded conical wedges 17, one of the stops 19 being disposed between the wedges 17. Normally, a chunk of wood can rest on the ground with its axis vertical and then be pushed against one of the conical wedges 17 and the wedge will auger itself into the wood, and when reaction begins, it will twist and engage the stop 18, or 19. If it be desired to split a longer log, the stops 18,19 can be removed, and the longer log can be disposed against both of the conical wedges 17 simultaneously. The removable stops 18,19 are illustrated in their preferred position for storage. Both are generally U-shaped and are slidably supported at both ends in sockets. They can be removed by merely lifting them out, and when replaced with the legs disposed in the outer socket, their upper ends provide sloping stop or guide surfaces on which a log can rest. The slope is such that round logs of different diameters will be simultaneously vertically centered with respect to the points of the wedges 17,17.

To operate the device, it is manually carried to the scene of proposed use, it readily fitting into the trunk of an automobile for that purpose. The vehicle is then driven onto the rollers 12,13 either by going forward or backward with either the left powered wheel or the right powered wheel becoming nested between and supported by the rollers 12,13. Preferably, the wires from the electrical switch 20 are suitably connected into a circuit of the motor vehicle to enable its operation to be stopped, should the occasion arise. It is contemplated that any commercial available motor vehicle has sufficient horsepower at its idling speed to drive this device. Therefore, the other driven wheel which is not on the rollers is preferably first blocked to make certain that all of the powwer from the engine will be transmitted by the differential gearing of the motor vehicle to the wheel engaging the rollers 12,13. The speed of operation can be selected by selecting the gear into which the vehicle is placed, and further adjustment can be made by adjusting the idling speed of the engine.

In the event that the vehicle has a positive drive differential, it would then be necessary to either jack up the other wheel or to provide a further set of rollers 12,13 for that wheel, to serve merely as idlers with nothing connected thereto. Alternatively, a further unit of the type disclosed could be placed on the other wheel so that a second operator could simultaneously split wood from the opposite side of the vehicle.

Another alternative involves the omission of certain of the disclosed components to provide a more basic or rudimentary smaller, lighter weight, cheaper device for those who have less need. To this end, one of the ramps 21,22 may be omitted and the frame appropriately shortened. Still further, one of the brackets 32,33 and the shaft and conical wedge 17 carried thereby could be omitted, thereby enabling the omission of one of each of the sprockets 37,34 and 36, one of the chains 35 and the chain 38, and the corresponding removable stop 18 or 19.

Any embodiment of the invention preferably includes handles by which the device can be carried and by which the device may be hung for storage.

The stripped down model using only one conical wedge 17 would be least expensive and would be suitable for a typical home owner. The full device as disclosed is intended for commercial usage. The device can be used for any weather condition, and the casing for the interconnecting means not only provides safety but weather protection for the same. The construction of the apparatus is such that its usefulness is not directed to any specific diameter or length of log. The apparatus will readily split the hardest of woods.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. A portable wood splitting device for use with a self-propelled motor vehicle, comprising:

(a) a frame adapted to rest on the ground and having a pair of upwardly extending brackets disposed at a lateral side thereof and projecting laterally beyond said frame;

(b) a pair of parallel horizontal drive rollers rotatably supported on said frame between said brackets and adapted to support and to be driven by a driven wheel of the motor vehicle when the same is supported thereon;

(c) a pair of horizontal shafts rotatably supported at the upper end of said brackets for rotation about a pair of axes disposed well above the axes of said drive rollers;

(d) means drivably interconnecting each of said drive rollers with both of said horizontal shafts (e) a pair of threaded conical wedges respectively corotatably and coaxially secured to said horizontal shafts, and each having a point directed away from said drive rollers, said wedges projecting laterally beyond both said brackets and said frame; and (f) a pair of slidably removable sloping log-centering stops projecting upwardly and laterally from said frame and lying generally in vertical spaced planes in spaced offset parallel relation to and at opposite sides of the rotational axis of one of said conical wedges for being engaged by the wood as it is being split.

2. A device according to claim 1, including an electrical switch accessibly supported on one of said brackets, and adapted to be connected into a circuit of said motor vehicle to stop its operation.

3. A device according to claim 1, said shafts having a speed ratio to said drive rollers of about 1 to 16.

4. A device according to claim 1, including a pair of ramps, on which the driven wheel may ride, extending from the lower level of said frame to opposite sides of said drive rollers.

* * * * *